US006141937A

United States Patent [19]

Dressler

[11] Patent Number: 6,141,937

[45] Date of Patent: Nov. 7, 2000

[54] HOLDER FOR ADJUSTABLE POSITIONING OF REINFORCING RODS

[75] Inventor: Bradley S. Dressler, Depew, N.Y.

[73] Assignee: Steele-Wich Inc., Buffalo, N.Y.

[21] Appl. No.: 09/504,993

[22] Filed: Feb. 15, 2000

Related U.S. Application Data

[62] Division of application No. 08/989,482, Dec. 12, 1997.

[51] Int. Cl.[7] ..... E04B 2/26

[52] U.S. Cl. ..... 52/742.1; 52/679; 52/687; 52/689; 52/298

[58] Field of Search ..... 52/678–689, 298, 52/742.1–742.5, 745.05, 745.09

[56] References Cited

U.S. PATENT DOCUMENTS

| | | | |
|---|---|---|---|
| 1,296,513 | 3/1919 | Havemeyer | 52/686 |
| 1,616,977 | 2/1927 | Koivu . | |
| 2,714,817 | 8/1955 | Griffiths . | |
| 3,145,505 | 8/1964 | Cornelius . | |
| 3,530,634 | 9/1970 | Adams | 521/687 |
| 4,107,895 | 8/1978 | LeGrady . | |
| 4,190,999 | 3/1980 | Hampton . | |
| 4,318,262 | 3/1982 | Uehara . | |
| 4,337,605 | 7/1982 | Tudek . | |
| 4,617,775 | 10/1986 | Padrun . | |
| 4,936,062 | 6/1990 | Golston et al. . | |
| 4,969,786 | 11/1990 | Barthomeuf et al. . | |
| 5,379,562 | 1/1995 | Hohmann . | |
| 5,533,239 | 7/1996 | Gall | 552/686 X |
| 5,896,722 | 4/1999 | Swenson . | |

*Primary Examiner*—Richard Chilcot
*Attorney, Agent, or Firm*—Phillips, Lytle, Hitchcock, Blaine & Huber LLP

[57] ABSTRACT

The current invention is directed to a holder (32) for adjustable positioning of reinforcing rods (49). The holder has a horizontal support structure and a means for holding a reinforcing rod (49). The holder is comprised of a first leg member (33), a second leg member (34), a spring (35) and a retaining member (41). The leg members are elongated for spanning one of the cells of a hollow block (20). The first and second leg members are configured and arranged to create a gap (37) therebetween for receiving the reinforcing rod. The spring is adapted to bias the leg members against the reinforcing rod to vertically suspend and selectively permit adjustment of the vertical position of the reinforcing rod during the construction of a hollow block wall (47). In the preferred embodiment, the leg members and the spring are integrally formed from a continuous wire member having a U-shaped profile.

The present invention also broadly comprises a hollow block wall construction incorporating the holders described above, and also a method of constructing a hollow block wall. As the wall is constructed, the holders permit the vertical reinforcing rods to be raised to approximately correspond to the height of the wall under construction.

8 Claims, 9 Drawing Sheets

HOLDER FOR ADJUSTABLE POSITIONING OF REINFORCING RODS

This is a division of copending application Ser. No. 08/989,482, filed Dec. 12, 1997.

TECHNICAL FIELD

The present invention relates generally to the field of holders used for positioning and locating reinforcing rods within hollow block walls, and, more particularly, to an improved device for positioning vertical reinforcing rods within the cells of hollow blocks so that selective horizontal and vertical positioning of the reinforcing rods is permitted during the construction of a hollow block wall.

BACKGROUND ART

A variety of methods have been used in the past to position and locate reinforcing rods within concrete structures. It is well known in the construction trade that concrete structures and hollow block walls must be reinforced to improve structured integrity. Such reinforcement is often accomplished by introducing metal bars or rods commonly known as reinforcing rods, reinforcing bars, or simply "rebars" throughout the structure. Typically, these rods are comprised of construction grade steel alloy. The present invention relates generally to steel reinforcement used in concrete block construction, and more particularly to a device for locating and positioning vertical steel reinforcing rods in appropriate locations during construction of a block wall. Further, the present invention is intended to precisely position the reinforcing rod so that the full tensile strength of the rod may be realized, thus meeting specified building codes and designs.

A common method for building walls is through the use of hollow blocks, also known as concrete masonry units (C.M.U.'s). These C.M.U.'s are also referred to as "cinder" or "concrete" blocks. These blocks are generally rectangular in shape and have two hollow cavities or cells located adjacent one another which extend through the central portion of the block. The cells are separated by a central web portion. In the construction of a wall, the blocks are laid in end to end horizontal alignment and joined using a cementitious binder, usually a mortar. Successive courses of blocks are then provided on top of the initial course. These successive courses are positioned so that the individual cells of each block partially align with the hollow cells of the blocks located in the courses below. Blocks are typically arranged in a staggered arrangement, known as a half-lap joint. In this form of construction. blocks are positioned to overlap those blocks immediately below to form a more stable wall structure. This arrangement results in the formation of a plurality of hollow cores extending vertically through the wall.

Masonry structures comprised of hollow blocks must often be reinforced to comply with design specifications and building codes. Reinforcement may be accomplished using several techniques. One of the most common techniques is through the installation of vertical reinforcing rods in the hollow cores of the wall. As stated above, the hollow cells of the individual blocks are aligned with the hollow cells of the blocks directly above and below to form hollow cores which extend vertically through the height of the wall. To strengthen the wall, cement, grout, mortar or some other form of cementitious binder is poured, pumped or injected into the cores after the vertical rods are installed. The cores are typically filled with grout, a thin form of mortar, which surrounds the rods and later hardens, to increase the strength of the wall.

In construction practice, reinforcing bars are generally provided in six foot lengths. This is a convenient length for manual handling. The bars are generally provided throughout the entire vertical extent of the wall. Most often, several vertical lengths are joined together to accomplish this goal. The vertical reinforcing rods are introduced into the hollow cores prior to introducing the grout. The number of vertical reinforcing rods along with their locations are dictated by building codes and design specifications. For instance, some applications may require that each core contain a vertical reinforcing rod. Other application may require vertical reinforcing rods at spaced intervals, for example, at every fifth core.

In practice, the length of the individual reinforcing rods is typically less than the height of the core to be reinforced. Hence, it is necessary to splice or tie several vertical reinforcing rods together such that a continuous reinforcing rod structure extends vertically through the entire height of the core. Building codes and design specifications dictate the necessary overlap between the rods comprising the vertical spliced joint. Such spliced joints are sometimes achieved by using wire to tie the vertical reinforcing rods together at the splice joint.

In a reinforced hollow block wall, horizontal reinforcing rods may also be used. These rods run perpendicularly to the vertical reinforcing rods. In practice, these horizontal reinforcing rods are typically placed in a "bond beam" course. In the horizontal direction of a hollow block wall, hollow cores are generally not present. Hence, the installation of horizontal rods is more difficult than the installation of vertical reinforcing rods. To facilitate installation of horizontal reinforcing rods, the outside webs and central web of the hollow blocks may be notched, or cut.

The vertical reinforcing rods are optimally tied, welded or otherwise connected to the horizontal rod to increase the strength of the hollow block wall and create a bar grid pattern. The vertical reinforcing rods must be accurately positioned to permit this connection, and prior art construction techniques are not believed to readily accommodate this connection.

Hollow block walls are further reinforced by the introduction of webbing, mesh or other planar reinforcing members within the horizontal mortar joints present between successive courses of block. During the construction of a hollow block wall, horizontal stiffeners may be placed or embedded in the mortar joint, further enhancing wall strength.

For structural purposes, it is important to precisely locate vertical reinforcing rods relative to the cells of the hollow blocks. Some applications may require vertical rods be positioned centrally within the cells, whereas other applications may require other lateral positions be maintained. Vertical positioning of the rods is critical for maintaining overlap in joints, positioning with bond beams and other related purposes.

Current methods of constructing a reinforced block wall are believed to be similarly unsophisticated. Typically, a foundation is first provided. This is most often a poured concrete structure. The foundation has a flat, upper surface. After appropriate measurements are made, the foundation may be drilled at regular intervals to receive vertical reinforcing rods. The vertical rods, however, are generally not installed at this time. An initial course of hollow blocks is then laid on the flat, upper surface of the foundation. The blocks are laid in horizontal end-to-end fashion, and are joined to one another and to the foundation by the use of a cementitious binder material, typically mortar. The mortar is applied to the outer edges, or "ears" of the hollow blocks using standard masonry techniques. Mortar is then applied to the upper surface of the first course of blocks using wellknown techniques and successive courses of blocks are laid atop this first course. The upper courses are overlapped to create the so-called "half-lap" joint.

After approximately two courses of block have been laid, vertical reinforcing rods are often lowered into the cores of the hollow blocks such that the lower ends of the reinforcing rods engage the pre-drilled holes in the foundation, and the rods are epoxied into place. The length of these vertical rods is approximately equal to the height of the courses aid at this time.

At this point, construction may then generally take one of two methods. In the first method of construction, additional lengths of reinforcing rod are tied or welded to the lower lengths of reinforcing rod.

Once the second set of vertical reinforcing rods has been installed, masons first lift the hollow blocks over the vertical reinforcing rods, and then lower the blocks down, such that the hollow blocks are "threaded" onto the reinforcing rods. This is a difficult and time consuming process. Great physical effort must be expended by the mason in lifting and lowering the blocks over the vertical rods. In addition, applying mortar to the blocks also presents problems. If the mortar is applied prior to the lifting and lowering process, the mortar is often inadvertently brushed off, or drops off due to the effects of gravity. Applying the mortar to the block after it has been lowered over the rods is also difficult because the block may not be easily maneuvered once it is installed over the rods. In addition, the vertical rods obstruct access to the various surfaces of the hollow block, impeding application of mortar.

Once the blocks have been laid to a height corresponding to the height of the vertically extending rods, additional vertical rods are connected to the lower rods which again extend above the height of the partially constructed wall. The process described above is repeated, and additional courses are laid until the height of the wall reaches the height of the vertically extending rods. This method is continued until the hollow block wall is constructed to a desired height. In this manner, a hollow block wall is constructed which contains continuous vertical reinforcement through the cores of the blocks. Horizontal bond beams may also be provided near the top of the wall, but this further complicate construction. Grout is then pumped into the cores, allowed to harden and the wall is complete.

The second well-known method for constructing a hollow block wall is to first construct the wall to its desired height and subsequently lower vertical reinforcing rods down into the cores. This method does not require masons to lift blocks up and over the vertical reinforcing rods and permits rapid construction of walls. At first impression, this method would appear to be the desired method for providing vertical reinforcing rods in a hollow block wall. However, for several reasons, this method has limited application.

First, building codes and design specifications almost universally require that vertical reinforcing rods run the entire height of the wall. Thus, if a single vertical rod is to be installed in a given core, sufficient headroom must exist so that the vertical rod may be positioned over the core and lowered in. In practice, the requisite overhead clearance is typically not present. Block walls are often built in multistory structures. Steel decks separate the floors and are constructed prior to installation of the hollow block walls. These decks thus limit the amount of overhead room. In addition, block walls are often constructed between preexisting floors and ceilings. These ceilings limit overhead clearance and make it impossible to lower in vertical rods after the wall has been constructed. This is because once the wall is constructed to ceiling height, no overhead clearance is available to lower in the vertical rods.

Other factors make it infeasible or impractical to lower in vertical rods after the wall is constructed. In many instances, pipes, ductwork, electrical conduit and other obstructions intersect the block wall at the precise location where a vertical reinforcing rod is to be positioned. This leads to the situation where vertical rods must be cut to allow for installation of such ductwork. In other situations, ductwork is already installed, and prevents the lowering of the vertical reinforcing rods. In yet other situations, horizontal meshing has been introduced and embedded in the horizontal joints of the block wall, further impeding installation of the vertical rod.

As a result, the most widely used method in constructing vertically reinforced block walls is the first method described. This entails the time consuming task of installing the vertical rods, and then raising and lowering the blocks over the rods to complete the construction of the wall.

The current holder technology, such as seen in U.S. Pat. No. 4,107,895 is not believed to permit the vertical adjustment and positioning of vertical reinforcing rods. Such reinforcing rod positioners span the open cells of the hollow blocks, and typically are designed to facilitate only horizontal positioning of the reinforcing rod within the hollow block cell.

Accordingly, it would be useful to develop a reinforcing rod holder which would make vertical positioning of the reinforcing bars a less onerous task. Further, it is desirable to provide an invention which would permit the construction of vertically reinforced, hollow block walls in areas with limited overhead clearance without the need to raise and lower blocks over preinstalled vertical rods.

It is believed that none of the prior art devices permits a block wall to be constructed while simultaneously raising the reinforcing rod through the hollow core of the block wall to correspond to the height of the block wall under construction.

DISCLOSURE OF THE INVENTION

With parenthetical reference to the corresponding parts, portions or surfaces of the disclosed embodiment, merely for purposes of illustration and not by way of limitation, the present invention provides an improved holder (32) for adjustable positioning of reinforcing rods (49) within one of a plurality of vertical cores (51) of a hollow block wall (47). The wall is constructed of a plurality of hollow blocks (20), having cells (22) and arranged such that the cells form a plurality of cores. The holder broadly comprises a horizontal support structure for spanning one of the cells, and a means for holding the reinforcing rod (49). The holding means permits selective adjustment of the vertical position of the vertical reinforcing rod. The horizontal support structure is arranged in operative relationship with the means for holding to vertically suspend the reinforcing rod within one of the vertical cores and selectively permits adjustment of the vertical position of the reinforcing rod.

In the preferred embodiment, the horizontal support structure is comprised of a first leg member (33), and a second leg member (34). The legs members are elongated for spanning one of the cells. The means for holding is comprised of a spring (35) having two ends in combination with the first and second members. The first leg member is connected to one of the ends of the spring (36) and the second leg member is connected to the other end of the spring (38). The first and second leg members are configured and arranged to create a gap (37) therebetween for receiving the reinforcing rod. The spring is adapted to bias the leg members against the reinforcing rod to vertically suspend and selectively permit adjustment of the vertical position of the reinforcing rod during construction of the hollow block wall. In the preferred embodiment, the leg members and the spring are integrally formed from a continuous wire member comprised of a flexible elastic material. Typically, this elastic material is a spring steel having a substantially circular cross-section.

The horizontal support structure has a thickness substantially less than the joint (46) formed between an upper course of hollow blocks (52) and a lower course of hollow blocks (52). This thickness permits placement of the holder within the joint. Accordingly, the spring and the leg members are co-planar to permit placement of the holder within the joint formed between the lower and upper courses of hollow blocks. In the preferred embodiment, the joint in which the holder is embedded is a full mortar bed joint. The holder further comprises a retaining member (41) attached to one of the leg members and extending inwardly into the gap for retaining and positioning the reinforcing rod. The retaining member may be integrally formed with one of the leg members.

In the preferred embodiment, one of the leg members is substantially longer than the other of the leg members to facilitate handling of the holder and to permit a pair of similar holders to be arranged in nested orientation on the upper surface (27) of a hollow block having two adjacent cells.

The reinforcing rod is typically provided with a plurality of protrusions (59) along its length. These protrusions form a plurality of grooves (60) therebetween and the leg members are dimensioned and proportioned to engage at least one of these grooves. This engagement permits the vertical reinforcing bar to be suspended and selectively permits adjustment of the vertical position of the rod. In the preferred embodiment, the gap and leg members are configured to vertically suspend at least two reinforcing rods. To further assist in retaining the reinforcing rods, a locking member (43) may be provided in the form of a plate member which connects the free ends (39, 40) of the two leg members.

In alternate embodiments, the horizontal support structure is comprised of a pair of similar first and second plate members (95). These plate members are elongated for spanning one of the cells of a hollow block. In this configuration, the means for holding is comprised of a collar (96) of substantially hollow cylindrical construction configured to receive the reinforcing rod. A lock element (98) is positioned within the collar to permit selective vertical adjustment of the reinforcing rod and a means for engaging (99) the lock element biases the lock element against the reinforcing rod.

In alternate embodiments, the horizontal support structure is again comprised of a pair of plate members (101). The plate members are elongated for spanning one of the cells of the hollow block. The means for holding is comprised of a collar (102) of substantially hollow cylindrical construction, configured to receive the reinforcing rod. A resilient lock insert (103) of substantially hollow cylindrical construction is positioned concentrically within the collar to permit selective vertical adjustment of the reinforcing rod. The resilient lock insert has an inner diameter suitable for imparting an interference fit with the reinforcing rod.

The horizontal support structure may also be a pair of spring legs (33, 34), each leg having first and second ends. The first ends are fixedly connected to one another and the second ends are free. The pair of spring legs are configured and arranged such that the holder has a substantially U-shaped profile which constitutes the means for holding. This U-shaped profile is capable of receiving at least one reinforcing rod. The spring legs are elongated for spanning one of the cores and are elastically deformable. After contacting the outer surface of the reinforcing rod, they exert a pressure on the exterior surface of the reinforcing rod. This pressure is of such a magnitude that the reinforcing rod may be vertically adjustable within one of the cores as successive courses of hollow blocks are added to the hollow block wall during construction.

The present invention also broadly comprises a block wall construction (47) comprising a plurality of hollow blocks. The blocks are arranged in end-to-end horizontal relationship with one another to form courses of hollow block. The hollow blocks and courses are joined to one another through the use of a cementitious binder material, such as mortar. The courses are arranged to permit vertical alignment of the cells to form a plurality of vertical cores. A plurality of holders (32) are included within the wall structure. The holders are selectively positioned between courses of blocks, and a plurality of vertically aligned reinforcing rods are positioned within certain cores so as to engage the holders. The holders thus permit the reinforcing rods to be vertically raised to a position approximately corresponding to the height of the wall as courses of block are successively stacked during construction.

The vertical reinforcing rods are held at both upper ends and lower ends by the holders. The holders are capable of receiving and vertically suspending at least two of the reinforcing rods and the holders may be vertically positioned between courses of blocks along a common core at locations corresponding to the length of the reinforcing rod being suspended. The holders may also be positioned in alternating horizontal orientation. In addition, where a number of vertical reinforcing rods are provided within a common core, the rods may be positioned in alternating opposite horizontal orientation with respect to the holders. Further, the wall construction may further include a horizontal reinforcing rod. Certain of the vertical reinforcing rods may be provided with specially configured upper ends to engage the horizontal reinforcing rod. Such specially configured upper ends may be J-shaped or L-shaped.

The present invention also broadly includes a method of constructing a hollow block wall comprising the steps of providing a plurality of hollow blocks, joining the hollow blocks in an end-to-end horizontal relationship, and providing successive courses of blocks atop the first course to form a plurality of stacked courses. The courses are joined by a cementitious binder material and arranged such that the cells of the hollow blocks form hollow cores extending through successive courses. A holder (32) is positioned on the top surface of one of the blocks and spans the core. A reinforcing rod is then inserted within the core and the holder engages this reinforcing rod such that the rod is vertically suspended in the core. Additional successive courses of blocks are then laid atop the highest existing course of blocks, and the reinforcing rod is selectively vertically adjusted within the holder in an upward direction as the additional courses are laid such that the upper end of the rod is vertically raised to approximately correspond to the height of the additional courses. This method is repeated until the wall is constructed to a desired height.

The cores are then filled with a cementitious binder material. This binder material is most often grout. In certain situations, the wall is vibrated to facilitate the flow of the cementitious binder material through the cores.

In particular, vertical adjustment may be achieved by first rotating the rod within the holder to unlock the rod, vertically raising the rod and then rotating the rod a second time to substantially lock the vertical position of the rod. Certain reinforcing rods are provided with a plurality of protrusions spaced regularly on a first portion of the outer surface of the rod to form a plurality of grooves there between. In addition, such rods are provided with planar portions (61) running the length of the rod. The first rotation causes the leg members to engage the pair of raised planar portions and the second rotation causes the leg members to engage one of the grooves so as to lock the vertical position of the rod. The method also encompasses incorporation of a horizontal reinforcing rod. The vertical reinforcing rods are raised adjacent to, and then connected to, the horizontal rod.

Accordingly, the general object of the present invention is to provide an improved holder for adjustable positioning of reinforcing rods in a hollow block wall construction.

Another object of the invention is to provide an improved holder which increases the structural integrity of the wall.

Another object of the invention is to provide an improved holder which permits a vertical reinforcing rod to be raised through a core present in a hollow block wall in approximate relationship to the height of the wall during construction of the wall.

Another object of the present invention is to provide an improved holder which permits construction of a hollow block wall without the need to raise and lower hollow blocks over pre-installed vertical reinforcing rods.

Another object of the present invention is to provide an improved holder which is readily installed during the construction of a wall.

Another object of the present invention is to provide a hollow block wall structure which incorporates the improved holders described in this invention.

Another object of the present invention is to provide a method for constructing a hollow block wall incorporating vertical reinforcing rods and the holders of the present invention.

Another object of the invention is to provide an improved holder which is readily modifiable, economical to manufacture, reliable, rugged, and may be used with a variety of hollow block wall constructions.

These and other objects and advantages will become apparent from the forgoing and ongoing written specification, the drawings, and the appended claims.

DESCRIPTION OF THE PREFERRED EMBODIMENTS

Figure 1:
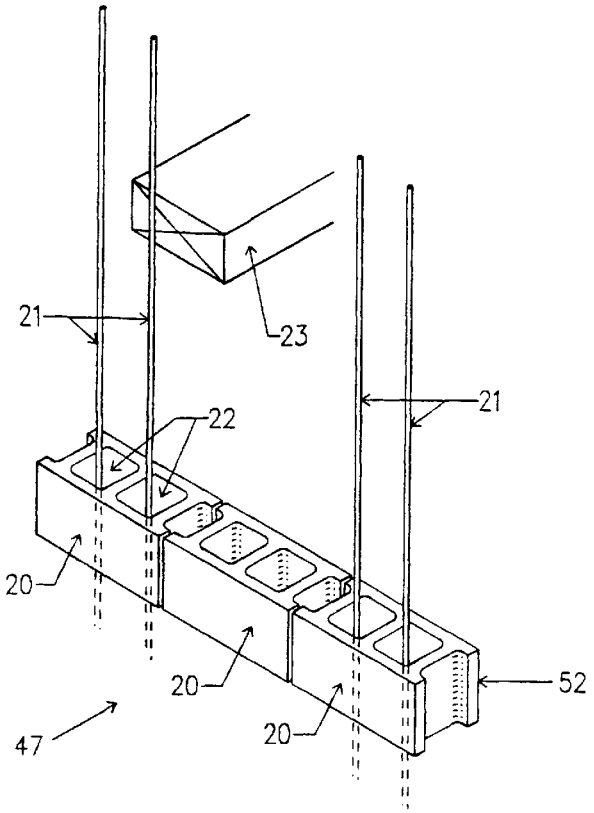
FIG. 1 (PRIOR ART)
FIG. 1 is a fragmentary cross-sectional perspective view showing a prior art method of constructing a hollow block wall.

At the outset, it should be clearly understood that like reference numerals are intended to identify the same structural elements, portions, or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up", and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Figure 2:
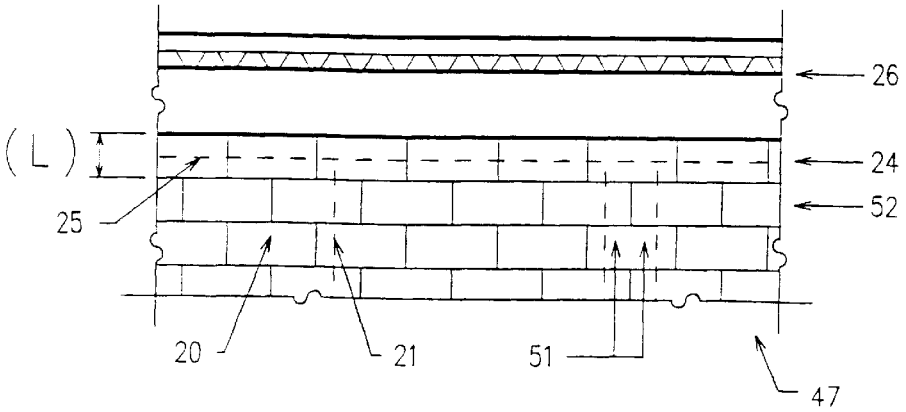
FIG. 2 (PRIOR ART)
FIG. 2 is a front elevation of a prior art embodiment demonstrating a bond beam, and a floor deck positioned above a hollow block wall.
Figure 3:
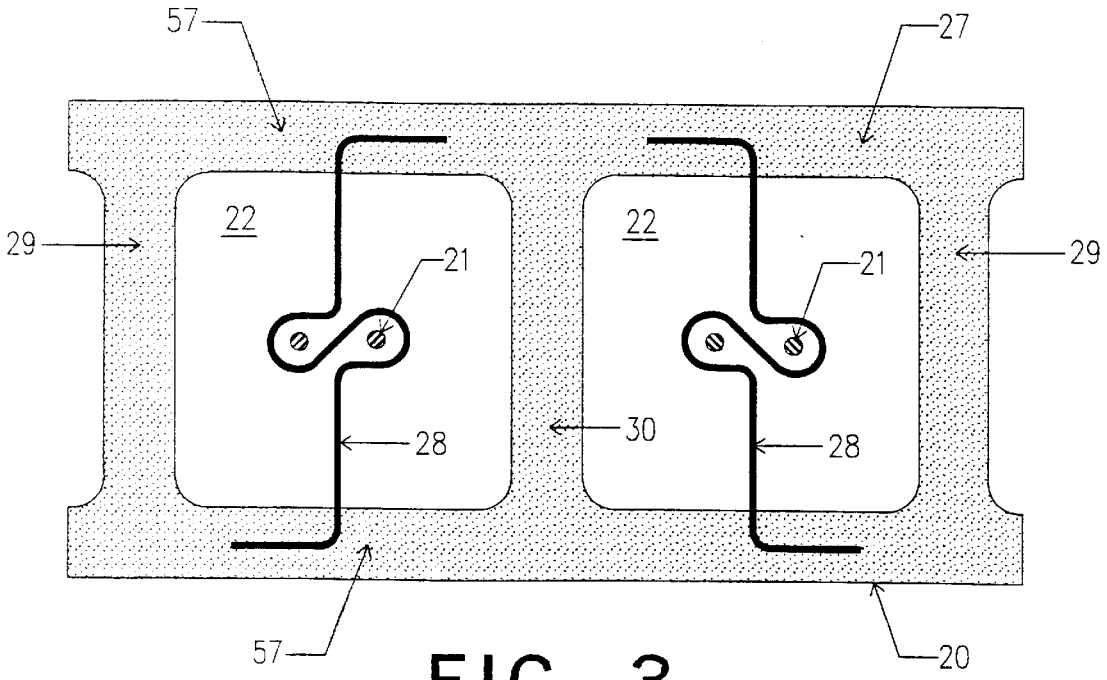
FIG. 3 (PRIOR ART)
FIG. 3 is a top plan view of a prior art reinforcing rod positioner.

Referring now to the drawings, and more particularly to FIGS. 1–3 thereof, certain prior art methods for constructing vertically reinforced block walls are depicted. FIG. 1 depicts a partially constructed hollow block wall 47 comprised of a plurality of hollow blocks, severally indicated at 20. Hollow blocks 20 have two cells 22 adjacent one another and extending there through. A plurality of elongated cylindrical vertical reinforcing rods, severally indicated at 21 are positioned within cells 22 of blocks 20. As discussed above, reinforcing rods 21 are fixedly positioned within cells 22 and are tied or welded to lower lengths of rod. Hollow block wall 47 is depicted in a partial state of construction. In order for masons to lay additional courses of block atop the highest existing course 52, hollow blocks 20 must be lifted vertically over the top ends of vertical reinforcing rods 21. This requires the expenditure of great physical effort. In addition, mortar applied to the webs, horizontal face shells, and vertical face shells of hollow block 20 prior to lifting and lowering may be knocked off during the installation process. The presence of obstructions, such as duct 23, may further impede construction.

FIG. 2 depicts the upper portion of a hollow block wall 47. As shown, a plurality of horizontal courses, severally indicated at 52, of hollow block have been stacked upon one another to form wall 47. A bond beam course 24 is provided. This course is a load bearing course and contains a horizontal reinforcing rod 25. Vertical reinforcing rods 21 are shown installed within vertical cores, severally indicated at 51. A floor deck 26 is provided above horizontal bond beam course 24. The presence of floor deck 26 precludes insertion of vertical reinforcing rod 21 subsequent to laying blocks 20. Hence, using prior art techniques, it is necessary to install vertical reinforcing rods 21 prior to installation of blocks 20. Blocks 20 must then be raised into the gap indicated by the letter "L", tilted, and lowered over vertical rods 21. After blocks 20 are installed, horizontal reinforcing rod 25. is installed in bond beam course 24. Because clearance "L" must be greater than the height of blocks 20, very often a gap exists between the tops of vertical reinforcing rods 21 and horizontal reinforcing rod 25. This is undesirable because, for structural purposes, vertical rods 21 should be tied or otherwise fastened to horizontal reinforcing rod 25.

Turning to FIG. 3, a pair of prior art reinforcing rod positioners, severally indicated at 28, are depicted. Hollow block 20 has a pair of outer web portions, severally indicated at 29, a pair of face shell webs, severally indicated at 57, and a center web portion 30. A pair of hollow cells, severally indicated at 22, are formed by these web portions. Prior art reinforcing rod positioner 28 spans cell 22 and positions reinforcing rod 21 centrally within cell 22 by loosely encircling the rod. However, reinforcing rod positioner 28 fails to grip or otherwise provide positive engagement of reinforcing rod 21. Thus, while use of the prior art positioner may be helpful to horizontally locate reinforcing rod 21 in the central portion of cell 22, it fails to accommodate vertical adjustment of rod 21. This is a critical limitation of the prior art.

Figure 4:
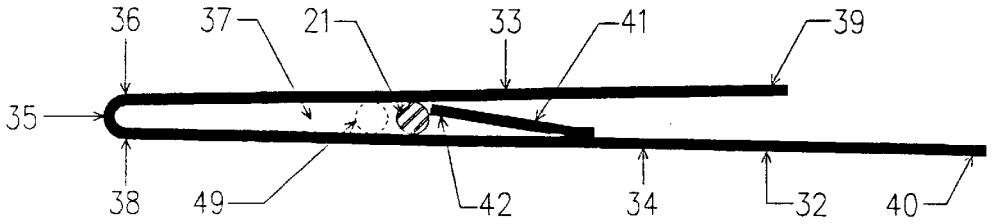
FIG. 4 is a top plan view of the reinforcing rod holder of the present invention.
Figure 5:
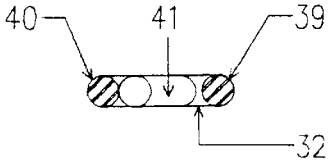
FIG. 5 is a right end elevation of the reinforcing rod holder of FIG. 4.

Referring now to the drawings, and more particularly to FIGS. 4 and 5 thereof, this invention provides an improved holder for positioning reinforcing rods within the cells of hollow blocks, of which the presently preferred embodiment is generally indicated at 32. The holder is shown as broadly including a first leg member 33, a second leg member 34, a curved or spring portion 35, and a retaining member 41. First leg member 33 is some-what shorter than second leg member 34 as shown. The portion of second leg member 34 extending beyond the free end 39 of first leg member 33 may be used as a handling device 40. Spring 35 is generally semicircular in shape and has a first end 36 and a second end 38. First leg member 33 is connected at one end to spring end 36 and second leg member 34 is connected to end 38. First leg member 33 and second leg member 34 define a gap 37 therebetween for receiving reinforcing rods, 21, 49.

Retaining member 41 is provided near the mid section of second leg member 34 and extends inwardly toward first leg member 33 such that second leg member 34, first leg member 33, spring 35 and retaining member 41 generally define an enclosed area for retaining reinforcing rods 21, 49. Retaining member 41 is provided with a free tip 42 which extends generally in the direction of spring 35.

First leg member 33, spring 35, and second leg member 34 generally define a U-shaped member. In the preferred embodiment, first leg member 33, second leg member 34, and spring 35 are integrally formed from a continuous wire member comprised of a flexible elastic material. In the preferred embodiment, this wire member is a spring steel having a substantially circular cross-section. However, in other embodiments, the wire member may have other cross-sectional geometries, such as square, triangular, hexagonal, oval or any other geometric shape.

In the presently preferred embodiment, holder 32 is formed from a continuous piece of 12 gauge wire. This wire may be protected from corrosion by galvanization or other similar treatment. First leg member 33 is approximately 8 inches in length and second leg member 34 is approximately 10 inches in length. Spring 35, in the presently preferred embodiment, has a radius of approximately 0.125 inches. In this embodiment, holder 32 is capable of holding reinforcing rods of varying diameter, from approximately 0.50 inches to 0.875 inches. A 12 gauge wire is believed optimal for installation within standard horizontal mortar joints. Other embodiments may easily accommodate rods having other diameters, by modification of the dimensions of the holder.

As seen in FIG. 4, first and second leg members 33, 34 generally define gap 37. Gap 37 is configured and arranged to receive at least one reinforcing rod 21. In the preferred embodiment, gap 37 is configured to receive two reinforcing rods, 21, 49. The reinforcing rods are introduced through the open end of the U-shaped profile of holder 32. The orientation of retaining member 41 serves as a ramp whereby reinforcing rod 21 is disposed between retaining member 41 and first leg member 33 during the insertion process and reinforcing rod 21 causes first leg member 33 to deflects outwardly so as to permit reinforcing rod 21 to be inserted fully within gap 37. After reinforcing rod 21 passes tip 42 of retaining member 41, spring 35 biases first leg member 33 toward second leg member 34 to retain reinforcing rod 21. In addition, leg members 33, 34 act as spring legs having the inherent spring characteristics of a cantilevered beam. This further serves to retain rods 21, 49. The magnitude of the force exerted by first leg member 33 and second leg member 34 on reinforcing rods 21, 49 is great enough to suspend the rods within the hollow cell 22 of block 20. Holder 32 is adapted to permit the reinforcing rods to be vertically adjustable when the rods are inserted within the core of a hollow block wall.

Figure 6:
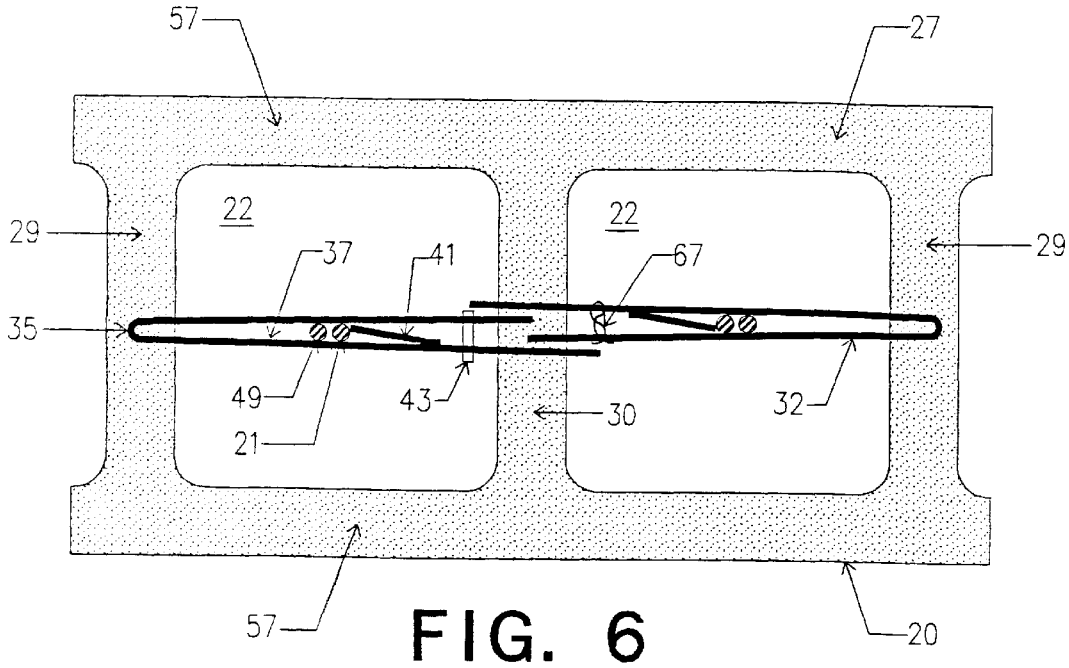
FIG. 6 is a top plan view of a pair of reinforcing rod holders centrally positioned over the cells of a hollow block.

Referring now to FIGS. 5 and 6, holder 32, in its preferred embodiment, has a substantially planar construction. First and second leg members 33, 34 are co-planar to permit placement of holder 32 between a lower course of hollow blocks and an upper course of hollow blocks in the construction of a hollow block wall. Typically, holder 32 is thin enough such that it may be inserted into a full mortar bed joint which separates an upper course of hollow blocks and a lower course of hollow blocks. As seen in FIG. 6, the full mortar bed joint consists of the placement of mortar (not shown) on both outer webs 29. center web 30 and outer face shell webs 57 of the top surface 27 of hollow block 20. As seen in FIG. 5, spring 35 is also co-planar with first and second leg members 33, 34 to permit installation in the mortar joint. This co-planar construction permits the holder to be installed at various locations throughout the hollow block wall without interfering with the normal construction process. In addition, by providing a holder having a thickness substantially less than the joint gap formed between an upper course of hollow blocks and a lower course of hollow blocks, the holder may be anchored or embedded within the joint gap by the surrounding mortar.

As best shown in FIG. 6, in the preferred embodiment, a pair of holders 32 are provided across cells 22 of hollow block 20. Holders 32 retain two reinforcing rods per holder. The reinforcing rods are provided within gap 37 and are retained from sliding out of the U-shaped holder by retaining member 41.

In certain embodiments, a locking member 43 may be provided which locks the two reinforcing rods laterally within gap 37 of holder 32. Further, locking member 43 prohibits the free ends of first and second leg members 33, 34 from deflecting outwardly. Hence, locking member 43 assists spring 35 in retaining reinforcing rods 21 and 49 within the holder. Locking member 43 may be in the form of a thin plate having two holes drilled therethrough, or in a double hook configuration designed to engage leg members 33, 34. In an alternate embodiment, as shown on the right hand side of FIG. 6, a wire loop 67 may be provided to tie first leg member 33 to second leg member 34 in the vicinity of retaining member 41. Wire loop 67 is typically formed from a continuous piece of straight wire and is simply wound or twisted about the leg members to securely hold reinforcing rods 21, 49. This is a low cost, yet effective, method for maintaining compression against the outer surfaces of the reinforcing rods.

Hollow block 20 is provided with an upper surface 27, a pair of outer webs 29, a pair of face shell webs 57 and a center web 30. As seen in FIG. 6, holders 32 are placed horizontally on upper surface 27 and span cells 22. Spring 35 and one end of leg members 33, 34 are placed on outer web 29 and the free ends 39, 40 of first and second leg members 33, 34 are placed on center web 30. In this manner, two vertical reinforcing rods 21, 49 are vertically suspended within each cell 22 of hollow block 20 such that the rods may be horizontally and vertically positioned with respect to cells 22. Leg members 33, 34 are configured to vertically suspend at least one reinforcing rod but may easily accommodate two rods. Spring members 33, 34 contact the outer surface of the reinforcing rods and exert pressure on the outer surface. The pressure is of such a magnitude that the reinforcing rods may be vertically adjustable within cell 22. After a vertical adjustment is performed, spring members 33, 34 exert sufficient pressure on the reinforcing rods so as to maintain the rods in vertical suspension within the cell.

As further shown in FIG. 6, holders 32 are arranged in a nested orientation such that the spring end of each holder is provided at outer webs 29 of hollow block 20 and the free ends are in a nested arrangement with respect to center web 30. Generally, first holder 32 is provided across one of the cells 22. The second holder 32 is arranged such that second leg member 34 of one of the holders generally aligns with first leg member 33 of the other of the holders. In this manner, a nested configuration results which enhances the structural integrity the wall.

Figure 8:
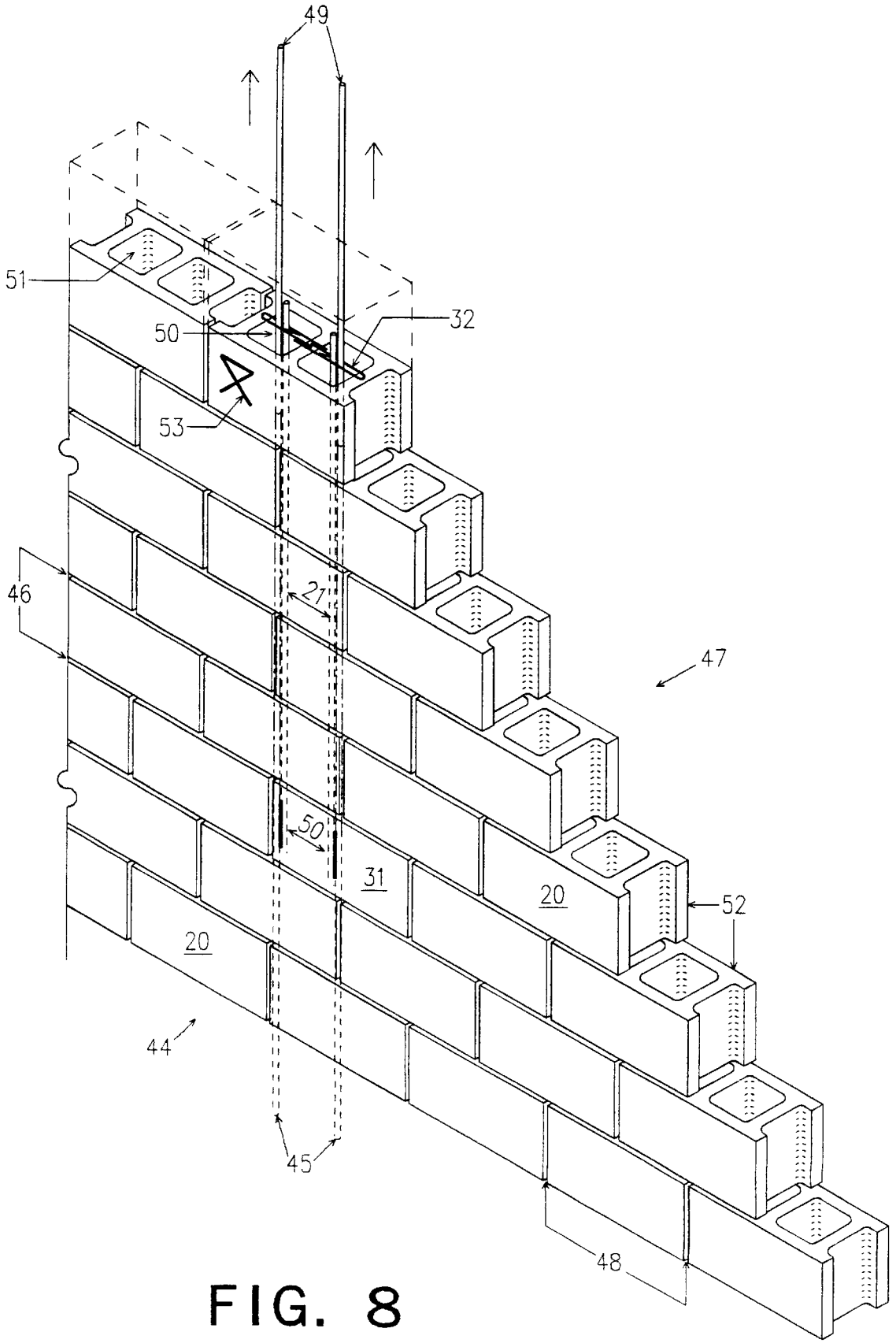
FIG. 8 is a fragmentary cross-sectional perspective view showing a hollow block wall in a state of partial construction and showing the positioning of reinforcing rods in the wall using the reinforcing rod holder of the present invention.

Referring now to FIG. 8, a partially-completed hollow block wall 47 is generally shown incorporating the present invention. At the foot of wall 47, a foundation 44 is provided. Such foundation is typically of poured concrete construction. A first course 52 of hollow blocks is provided atop foundation 44. Hollow blocks 20 are arranged in end-to-end horizontal relationship with one another to form first course 52. Each hollow block 20 is connected to the other hollow blocks through the use of a suitable mortar provided in the joint gap between the blocks. Horizontal mortar joints, severally indicated at 46, connect the courses of hollow blocks. Each hollow block 20 is then connected to the adjacent hollow block by means of vertical mortar joints, severally indicated at 48. While mortar is the preferred material to join hollow blocks 20, any cementitious binder material, such as cement or grout, would be suitable for this joining process. Often, the binder material is specified by the design engineer or by building code.

In the lower courses of the hollow block wall 47, a plurality of vertical foundation reinforcing rods, severally indicated at 45, are provided vertically within cells 22. Foundation 44 is pre-drilled at various locations corresponding to vertical foundation reinforcing rods 45. The precise location of rods 45 is typically specified by building code or design requirements. The lower ends of rods 45 are then hammered or pounded into the holes present in foundation 44 and may be epoxied in place.

As best shown in FIG. 8, hollow block wall 47 is constructed using the so-called half-lap type joint. In this type of construction, a first course of blocks 52 is provided. A second course of blocks is then provided atop this first course. The blocks of the second course are arranged such that one half of each block of the upper course spans two blocks of the lower course. In this manner, the upper blocks overlap the lower blocks to form the half lap joint. This is done to improve the structural integrity of hollow block wall 47. Cells 22 of hollow blocks 20 are so configured and proportioned such that a plurality of cores, severally indicated at 51, extend vertically through hollow block wall 47. Hollow cores 51 accommodate the presence of vertical reinforcing rods.

After hollow block wall 47 is constructed to a height generally corresponding to the height of vertical reinforcing rods 45, additional steps must be taken to accommodate the use of vertical reinforcing rod in the upper courses of the hollow block wall.

In practice six foot lengths of vertical reinforcing rod are used, as this is a convenient length for manual handling. At this time, an additional six courses of block are laid in place atop the existing two courses such that the block wall has a partially-constructed height of eight courses. At this time, two six foot lengths of reinforcing rod, 21 and 49, are lowered into each core 51, and both rods are inserted into a single holder 32. Holder 32 is then placed on the top surface of block 20 and suspends both rods within core 51.

As seen in FIG. 8, the lower end of rod 21 overlaps with rod 45. The hollow block positioned at this overlap position may have one of its face shell webs 57 removed to permit the lower end of rod 21 to be welded to the upper end of rod 45. This is done to provide a continuous vertical reinforcing structure. A slab 31 is then mortared into place subsequent to welding to enclose the welded joint. Additional courses of block are now laid atop the eighth course, presently the highest course. Rod 49 is currently in parallel adjacent relationship with rod 21, as indicated by the "center-type" dashed lines in FIG. 8. However, as additional courses of block are laid, rod 49 is adjusted vertically upward such that its upper end is approximately the same height as the top of the most recently laid course of block. This process is continued until reinforcing rod 49 is raised upwardly for another eight courses. Rod 21 and rod 49 now span approximately 11 vertical feet and overlap each other at overlap zone 50. The wall may be marked with symbol 53 to indicate the location of holder 32.

Figure 7:
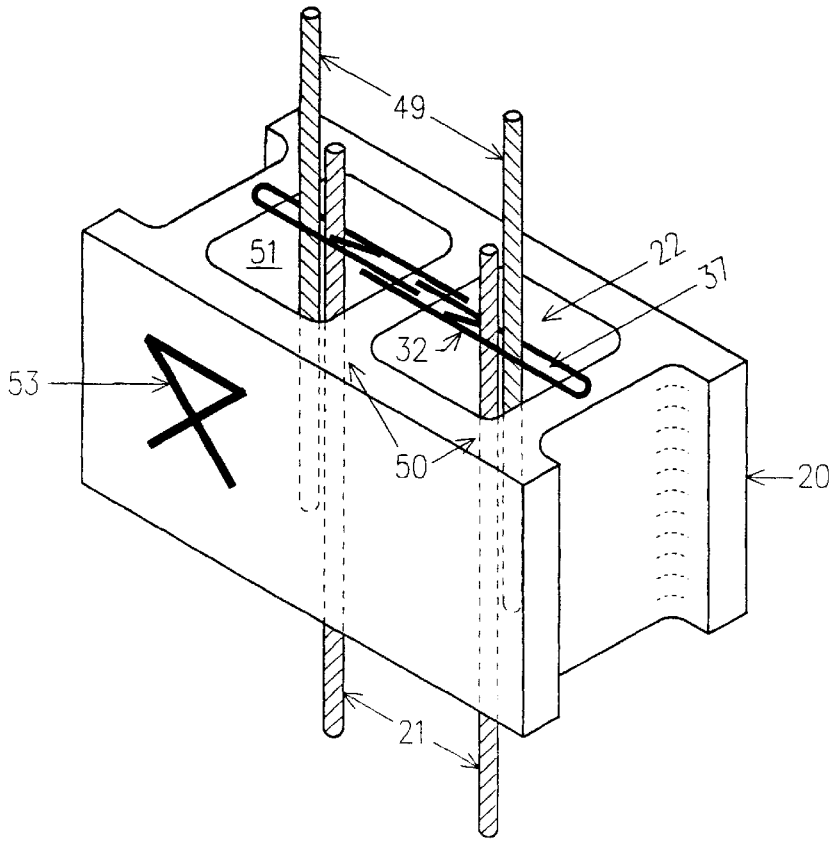
FIG. 7 is an enlarged perspective view showing a single hollow block and a pair of the reinforcing rod holders of the present invention, each holder engaging a pair of reinforcing rods.

FIG. 7 is an enlarged view of the upper portion of FIG. 8. As shown therein, a pair of lower vertical reinforcing rods, generally indicated at 21, are provided within gaps 37 of holders 32. The upper ends of rods 21 are disposed against retaining members 41. Upper vertical reinforcing rods 49 are positioned in parallel adjacent orientation with lower vertical reinforcing rods 21. Upper reinforcing rods 49 are positioned such that upper vertical reinforcing rod 49 is closer to spring 35. Referring to FIG. 7, mortar, (not shown), is provided on all portions of upper surface 27 of hollow block 20 to create the so-called full mortar bed joint. This results in a very strong joint. In the half mortar bed joint, no mortar is applied to outer webs 29 and center web 30. Holder 32 may be used with any form of mortar joint, but the full mortar bed is preferred.

Generally, not every core 51 receives vertical reinforcing rods. The specific placement of such reinforcing rods is dictated by strength requirements, code requirements and other factors.

Figure 9:
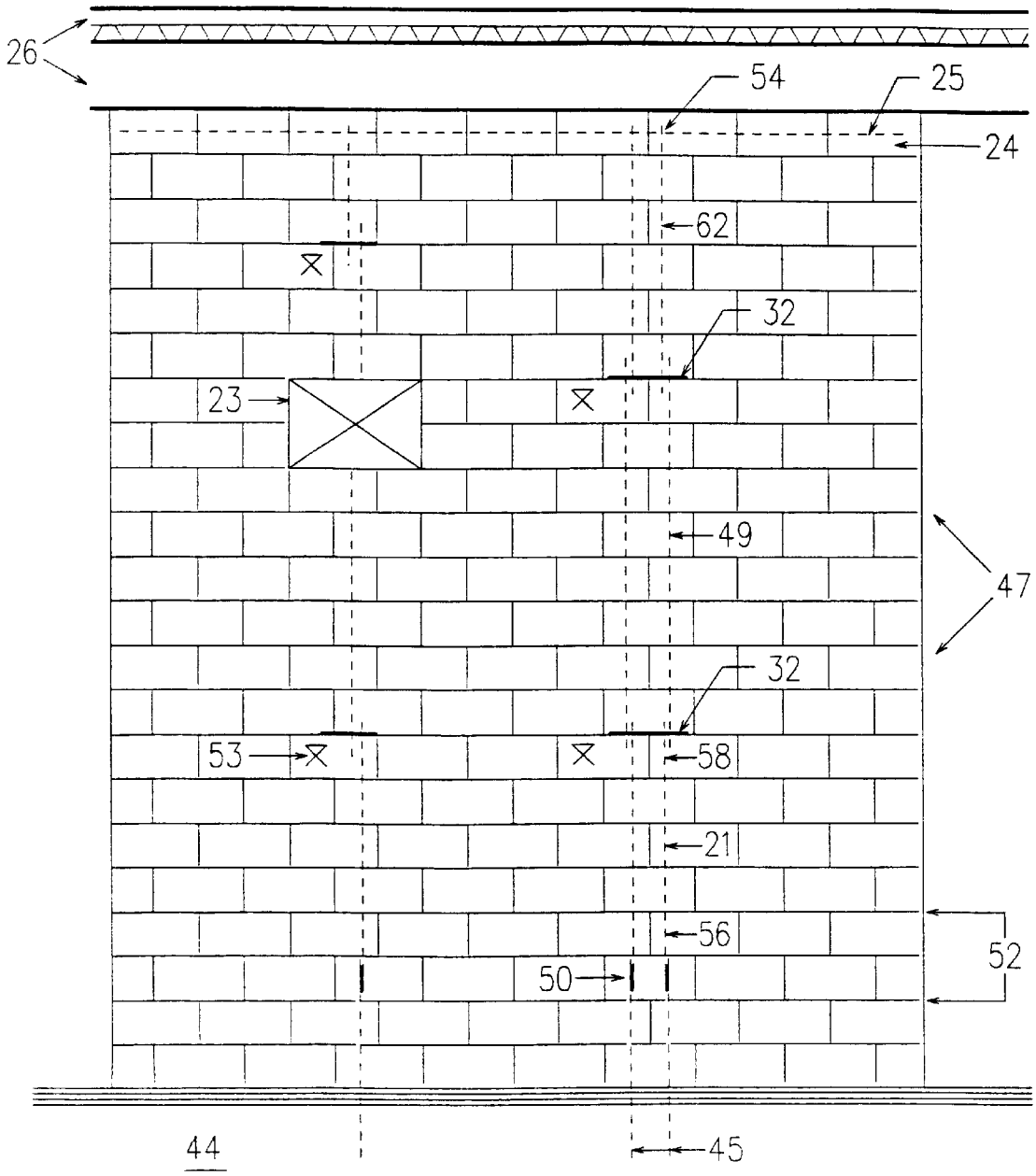
FIG. 9 is a front elevation of a hollow block wall showing installation of the reinforcing rod holder of the present invention along with a floor deck.

FIG. 9 is a vertical elevation of a completed hollow block wall 47. As shown therein, a plurality of holders 32 are provided at intermittent spacings along the vertical axis of core 51. Reinforcing rod 45 is secured at its lower end within foundation 44. Reinforcing rods 21, 49 and 62 extend the length of core 51. The bottom end 56 of rod 21 is welded to rod 45. The upper end 58 of vertical reinforcing rod 21 is retained by holder 32. The lower end of vertical reinforcing rod 49 is also secured by holder 32 and the upper end of vertical reinforcing rod 49 is secured by a second holder 32. The top most portion of vertical reinforcing rod 62 is then welded or otherwise secured at joint 54 to horizontal reinforcing rod 25 at bond beam course 24.

A number of ducts 23 may be present at various locations throughout hollow block wall 47. These are necessary to permit HVAC ventilation, electrical conduit, pipelines, and other connectors to extend through the hollow block wall. In addition, reinforcing rods must be positioned above and below such duct work. These ducts provide discontinuities in the vertical cores 51 so as to complicate placement of vertical reinforcing rods through such cores.

Holder 32 facilitates the construction of hollow block wall 47 by providing a straight forward method for positioning vertical reinforcing rods within cores 51. The method of construction is as follows. First, foundation 44 is provided. Thereafter, two courses of hollow blocks 52 are layed. Reinforcing rods 45 are inserted into vertical cores 51 present in courses 52 and fitted and epoxied within predrilled holes present in foundation 44. The upper portion of vertical reinforcing rod 45 is approximately flush with the upper surface of the third course of hollow blocks to be layed. At this point, six additional courses are laid for an overall wall height of eight courses. A pair of holders 32 is provided to span cells 22 of the upper most hollow block 20. Reinforcing rods 21 and 49 are lowered into core 51 and both are inserted into the open end of holders 32 such that the reinforcing rods are firmly positioned within gap 37 and in contact with first leg member 33 and second leg member 34.

Holder 32 is expanded against the restoring forces of spring 35 such that reinforcing rods 21, 49 are positioned within gap 37. The lower ends of reinforcing rods 21 and 49 initially lie approximately adjacent to the upper end of vertical reinforcing rod 45. Hence, reinforcing rods 21 and 45 lie side by side and in parallel relationship to one another. At this point, the lower end of vertical reinforcing rod 21 is welded to rod 45 at overlap zone 50.

An additional course of hollow block 52 is then layed atop holder 32 in a full mortar bed joint to complete the installation of holder 32. Because reinforcing rod 49 is contained within the courses of block already layed, the mason has no need to lift the hollow block above the reinforcing rod during construction of the wall. After an additional course of blocks has been laid, the mason then reaches into the cell of the block lying above vertical reinforcing rod 49, grasps reinforcing rod 49 and vertically adjusts reinforcing rod 49 until the top end of rod 49 is approximately flush with the upper surface of the top most hollow block. Holder 32 continues to suspend both rods 21 and 49. Additional courses of block are then layed atop the highest existing course. Similarly, the mason again reaches down within the most recently layed block, grasps rod 49 and vertically raises the rod such that the top portion of the rod is approximately flush with upper surface 27 of the top most hollow block. In this manner, hollow block is layed in horizontal courses without interference from the vertical reinforcing rod. Vertical reinforcing rod 49 is then raised as construction of the wall progresses to greater heights. This process is continued as additional courses are laid.

As shown in FIG. 8, the outer surface of the wall may be marked with symbol 53 to indicate the position of holders 32. This guarantees that reinforcing rod 49 will not be raised to a height that destroys the overlap of rod 21 and rod 49. As discussed earlier, the overlap between the vertical reinforcing rods found within a single core is critical to maintain the structural integrity of hollow block wall 47.

At the point where reinforcing rod 49 reaches its maximum vertical extent, a second set of holders 32 is provided as shown in FIG. 9. A new length of vertical reinforcing rod 62 is lowered into vertical core 51 and lies in parallel adjacent alignment with rod 49. Again, both rods 62 and 49 are retained within a common holder 32. Rod 62 is inserted into core 51 such that the top of rod 62 is at approximately the same height as the top of rod 49. Additional courses of hollow block 52 are then layed atop the highest course of block, and rod 62 is then adjusted in a vertical direction as construction proceeds such that the top of rod 62 is raised to correspond to the height of the upper surface of the highest course of hollow block 52.

To maintain the central location of the varying lengths of vertical reinforcing rod within cores 51, the orientation of holders 32 is alternated such that the holders provided at the top of the next successive reinforcing rod are oriented 180° opposite the holder positioned at the lower end of the reinforcing rod. While the method discussed is preferably used with six foot lengths, any length rod may be utilized so long as there is sufficient head room for insertion of the rod into core 51. It is noted that the insertion of two rods of a given length in a single holder may be extended to cover the combined vertical height of both rods less the overlap zone.

This nesting arrangement also increases the structural integrity of the wall by tending to lock movement of the reinforcing rods in the direction of elongation of holders 32. Further, this method ensures the proper overlap between spliced sections of vertical reinforcing rod, as established by building code and/or design specifications.

Figure 10:
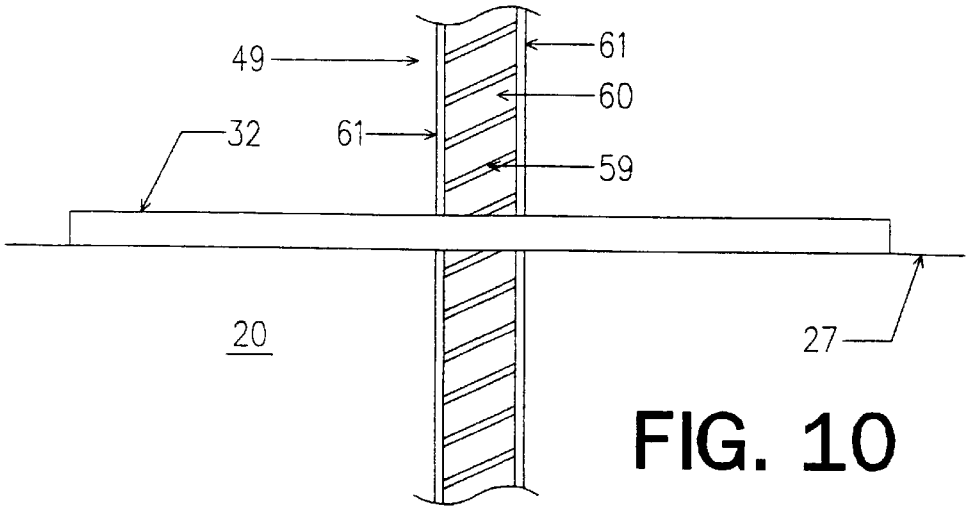
FIG. 10 is an enlarged vertical front elevation showing the reinforcing rod holder of the present invention retaining a single reinforcing rod.
Figure 11:
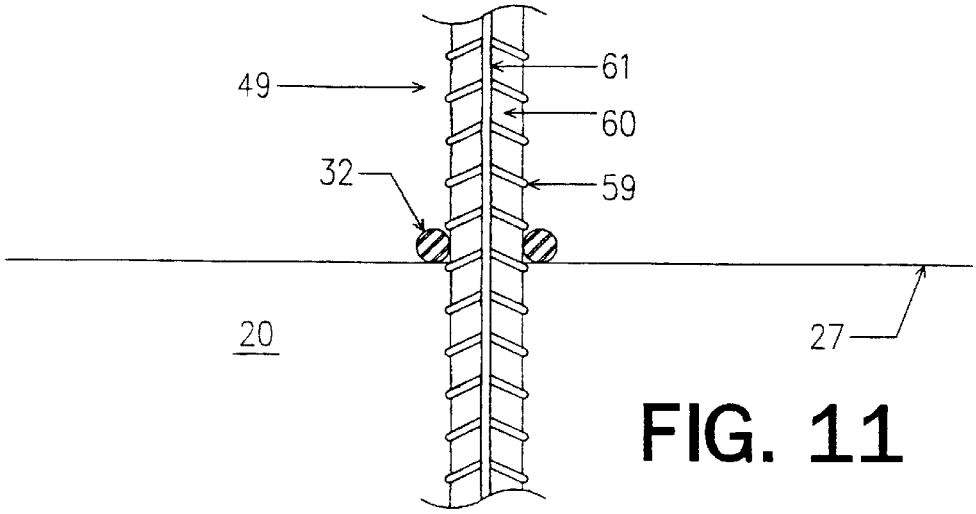
FIG. 11 is an enlarged vertical right end elevation of the reinforcing rod holder shown in FIG. 10.

The typical geometry of a standard reinforcing rod may be used to facilitate the operation of this invention. As shown in FIGS. 10 and 11, reinforcing rod 49 is often provided with a plurality of protrusions, severally indicated at 59. These protrusions are spaced regularly on the outer surface of rod 49 to form a plurality of grooves, severally indicated at 60, between the protrusions. In addition, rod 49 is provided with a pair of raised planar portions, severally indicated at 61, which run the length of the rod. Protrusions 59 terminate at planar portions 61. FIGS. 10 and 11 depict reinforcing rod 49 in a so-called locked arrangement. As best seen in FIG. 11, the orientation of rod 49 is such that leg members 33, 34 engage one of the grooves 60 to prevent rod movement in a vertical direction. The compressive forces exerted by leg members 33, 34 on the outer surface of rod 49 generally prevent vertical motion. However, upon application of sufficient upward force, protrusions 59 will cause first and second leg members 33, 34 to deflect outwardly to permit the rod to be vertically raised. In a similar fashion, rod 49 may be raised vertically by first rotating rod 49 about its axis of elongation approximately ninety degrees, and raising the rod.

Figure 12:
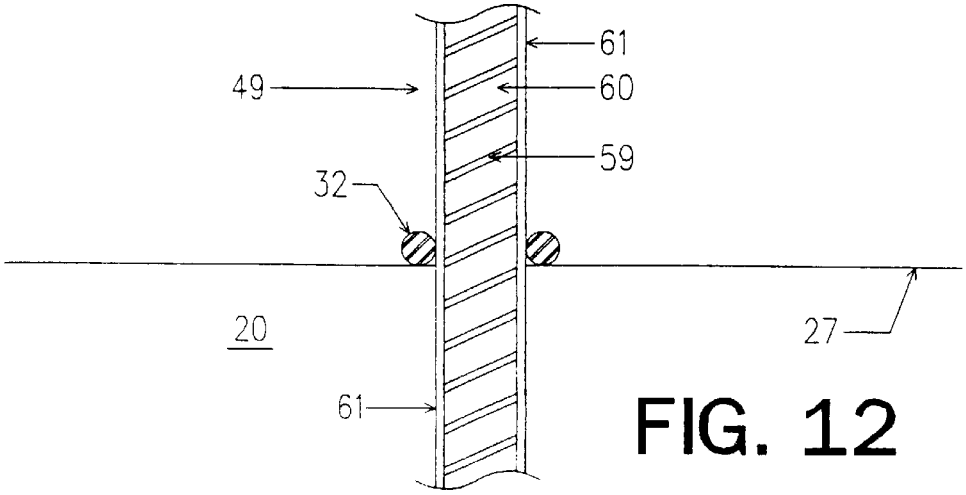
FIG. 12 is a view generally similar to FIG. 11, showing the reinforcing rod rotated 90° about its axis of elongation.

FIG. 12 depicts the same general view as FIG. 11, however, vertical rod 49 has been rotated ninety degrees about its axis of elongation such that planar portions 61 now engage first and second leg members 33, 34. In this orientation, vertical rod 49 may be raised upwardly by the application of a small upward force. This is because it is no longer necessary for protrusions 59 to be pulled past first and second leg members. In practice, vertical adjustment of rod 49 is achieved as follows. First, reinforcing rod 49 is provided within holder 32 as detailed above. The top of reinforcing rod 49 is approximately at the same height as the top of the highest course of hollow blocks 20. After an additional course of blocks is layed, the mason reaches into cell 22, grasps reinforcing rod 49 using either his or her hands or a tool, and rotates rod 49 such that planar portions 61 are in contact with first and second leg members 33, 34 of holder 32. The mason then vertically raises reinforcing rod 49 until the top of the reinforcing rod is now at approximately the same height as the upper surface of the top most block. At this point, the mason then rotates reinforcing rod 49 to its original angular orientation such that first and second leg members now engage groove 60 to prevent vertical movement. This tends to lock the vertical reinforcing rod from unintended motion.

It is noted that holder 32 may accommodate a number of different reinforcing rod geometries. In addition, holder 32 may accommodate reinforcing rods having varying diameters. Hence, in the situation where a heavy reinforcing rod is used, i.e., one having a large diameter, the weight of the reinforcing rod may be great enough to overcome the frictional forces imposed by first and second leg members 33, 34 when planar portions 61 are aligned with the leg members. Hence, it sometimes becomes necessary to rotate reinforcing rod 49 to insure that the rod does not unintentionally slip down into core 51.

Figure 14:
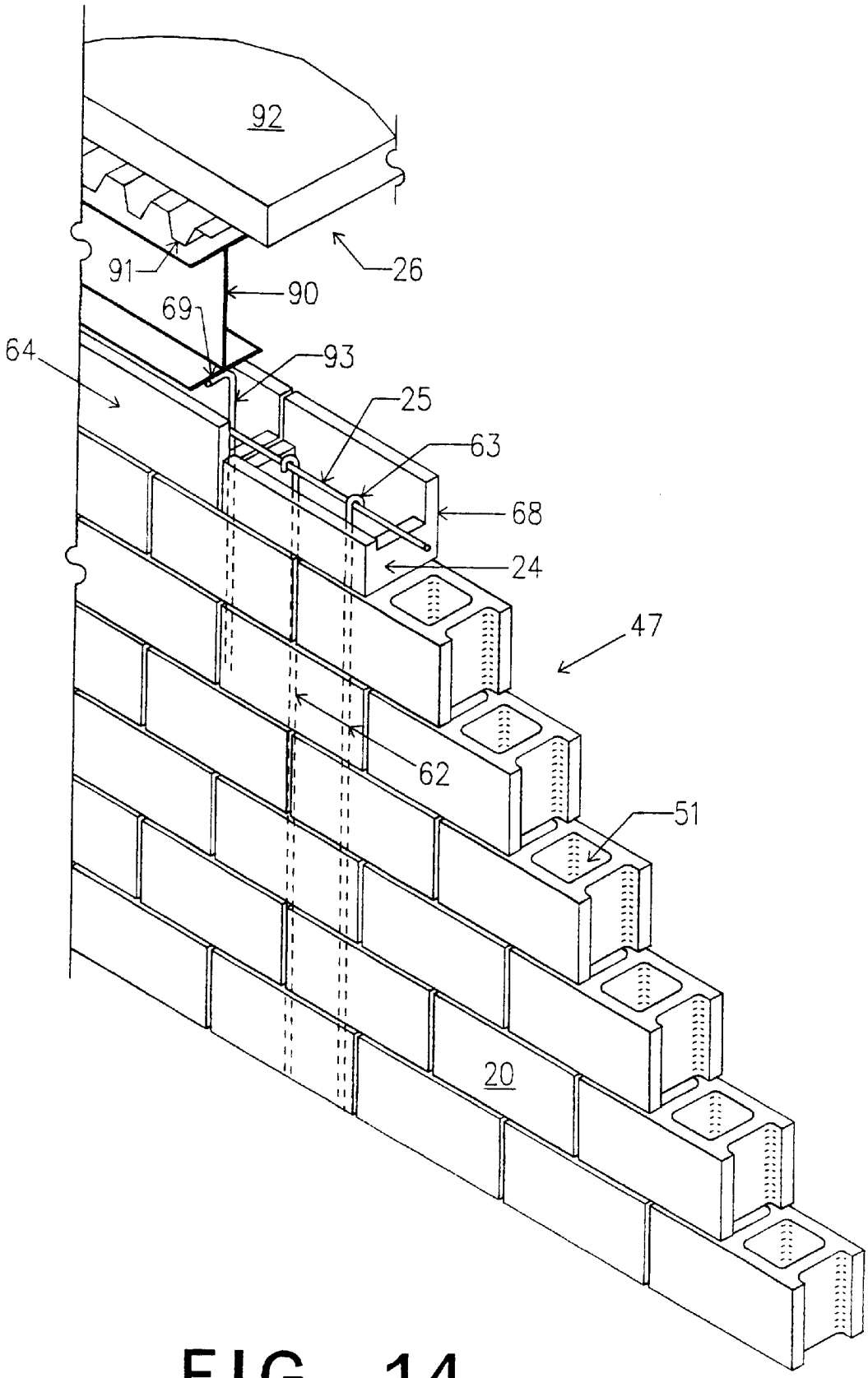
FIG. 14 is a fragmentary cross-sectional perspective view showing the upper portion of a hollow block wall containing a bond beam course, and utilizing the holders of the present invention.

Turning now to FIG. 14, the upper portion of hollow block wall 47 is depicted. As shown therein, horizontal reinforcing rod 25 is provided. In addition, a plurality of specially-configured hollow blocks 64, known as bond beam blocks, are provided to form bond beam course 24. This bond beam course is a load bearing member intended to support various forces transmitted through the structure. For structural purposes, it is important that vertical reinforcing rods 62 be firmly attached to horizontal rod 25. The present invention is particularly suited to insuring connection of vertical reinforcing rods 62 with horizontal reinforcing rod 25. As shown in FIG. 14, in certain installations, the upper most vertical reinforcing rod 62 is a specially-configured member. Reinforcing rod 62 has a J-shaped upper end 63 for engagement with horizontal reinforcing rod 25. By use of adjustable holder 32, vertical reinforcing rod 62 may be raised and lowered such that J-shaped end 63 engages horizontal reinforcing rod 25.

Figure 13:
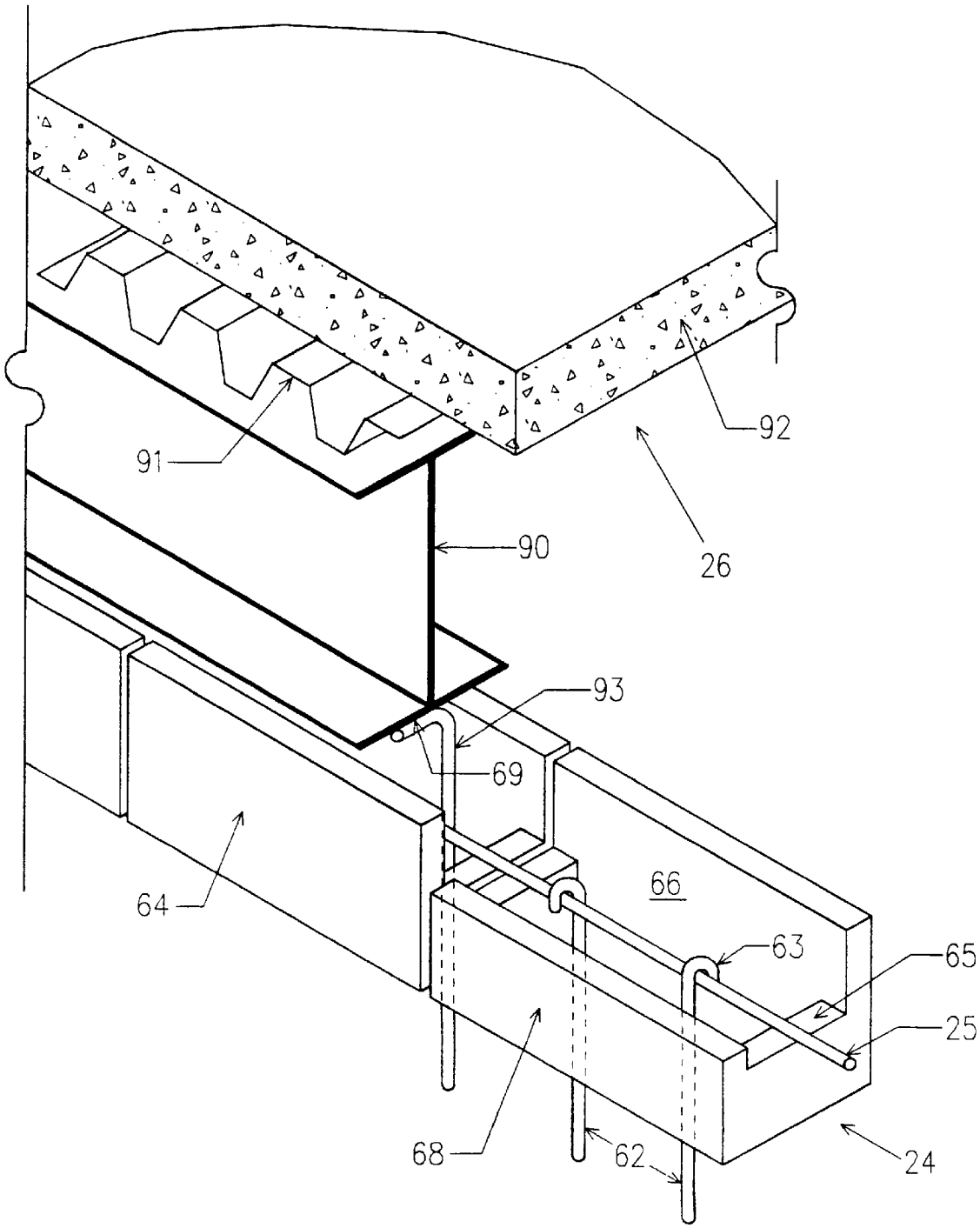
FIG. 13 is an enlarged fragmentary cross-sectional perspective view showing the upper end of a hollow block wall utilizing the holders of the present invention and depicting a the bond beam course along with a horizontal reinforcing rod.

FIG. 13 is an enlarged view of the upper portion of FIG. 14. As seen in FIG. 13, a shoe block 68 is provided with step surface 65 to permit installation of horizontal reinforcing rod 25. The outer walls of bond beam block 64 and shoe block 68 define a channel 66 for receiving horizontal reinforcing rod 25. Due to the vertical adjustment capability of holder 32, reinforcing rods 62 may be raised, rotated and lowered to engage horizontal reinforcing rod 25. In addition, the respective orientation of rods 62 may be alternated as shown in FIG. 13 to further increase structural stability. Shoe blocks 68 are provided in a similar fashion to bond beam blocks 64, but have a portion of their face shell webs removed for access purposes. By permitting vertical adjustment of rod 62, precise engagement of rod 62 and rod 25 may be assured. Deck 26 is immediately above bond beam course 24. Deck 26 is generally comprised of an I beam 90, a corrugated floor 91 and a poured concrete floor 92. As discussed earlier, the presence of deck 26 prevents insertion of vertical reinforcing rods into core 51 subsequent to construction of hollow block wall 47. The present invention illustrates the desirability of being able to vertically raise reinforcing rods in correspondence to raising the height of the wall during construction.

As shown both in FIGS. 13 and 14, vertical reinforcing rod 62 may, in some situations, be provided with an L-shaped upper end 93. This is typically formed by bending reinforcing rod 62 at a ninety degree angle. To enhance the structural integrity of wall 47, vertical reinforcing rod 62 may be vertically adjusted such that L-shaped upper end 93 abuts the lower surface of I beam 90. L-shaped end 93 may then be welded to I beam 90 to prevent motion of the vertical reinforcing rods. This greatly enhances the structural integrity of wall 47.

After wall unit 47 has been constructed as shown in FIG. 14 and suitably formed to enclose shoe block 68, leaving access grout keys (not shown), grout is then pumped, poured or otherwise introduced into vertical cores 51. The grout surrounds the vertical reinforcing rods contained within cores 51 and hardens to form a reinforced concrete structure. In addition, channel 66 of bond beam course 24 is also filled with grout to insure that horizontal rod 25 is encased in a grout mixture. The hollow block wall may in some situations be subjected to vibration to facilitate the flow of grout through vertical cores to ensure compaction of the grout within the contained areas. Once the grout mixture hardens, the bond beam is suitable for carrying specified loads.

Figure 15:
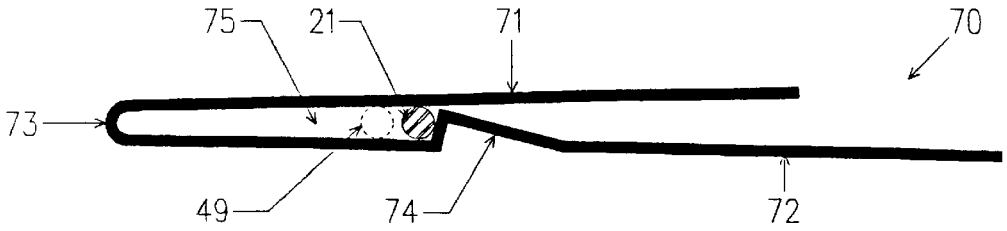
FIG. 15 is a top elevation of an alternate embodiment of the reinforcing rod holder of the present invention.

A variety of different configurations may be envisioned for holder 32. FIG. 15 depicts alternate holder 70. Alternate holder 70 is comprised of a single continuous wire member formed in a U-shape. It is comprised of a first leg member 71, a spring 73, and a second leg member 72. A retaining member 74 is integrally formed with second leg member 72 rather than welded or connected on by other methods. Leg members 71, 72 generally define a gap 75 for receiving at least one reinforcing rod 49. This holder functions in a similar manner as the holder described above. In addition, gap 75 is capable of holding reinforcing rods of varying diameters, and is capable of holding more than one reinforcing rod. This is believed to be a low cost embodiment.

Figure 16:
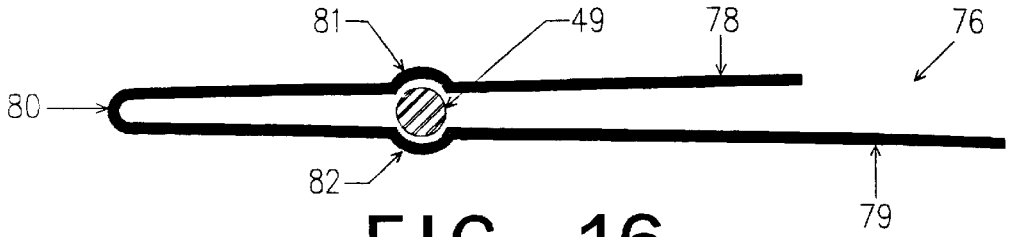
FIG. 16 is a top elevation of an alternate embodiment of the reinforcing rod holder of the present invention.

FIG. 16 depicts yet another embodiment of the holder. Holder 76 is comprised of a first leg member 78, a spring 80 and a second leg member 79. Together, these elements generally define a U-shaped profile. In addition, first leg member 78 contains a semi-circular retaining portion 81, and second leg member 79 contains a second semi-circular retaining portion 82. The diameters of the semi-circular retaining portions are generally equal to the diameter of the reinforcing rod to be held. As shown in FIG. 16, reinforcing rod 49 is retained by retaining portions 81, 82 to prevent lateral movement with respect to holder 76 and to provide vertical compressive forces on the outer surface of rod 21.

Figure 17:
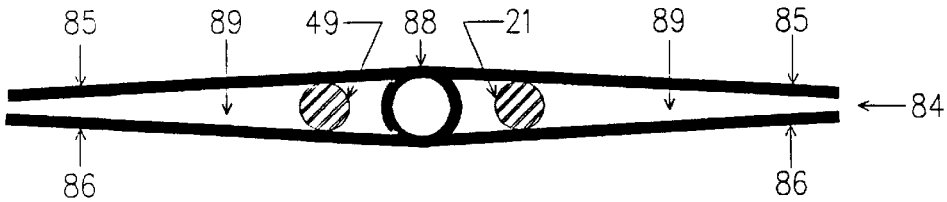
FIG. 17 is a top elevation of an alternate embodiment of the reinforcing rod holder of the present invention.

FIG. 17 depicts an alternate embodiment of the invention. Here, holder 84 is comprised of a pair of first leg members, severally indicated at 85, and a pair of second leg members, severally indicated at 86. A torsion spring 88 is provided between the pairs of leg members. Torsion spring 88 and leg members 85, 86 generally define two gaps, severally indicated at 89. Reinforcing rods 21 and 49 are then retained within gaps 89.

Figure 18:
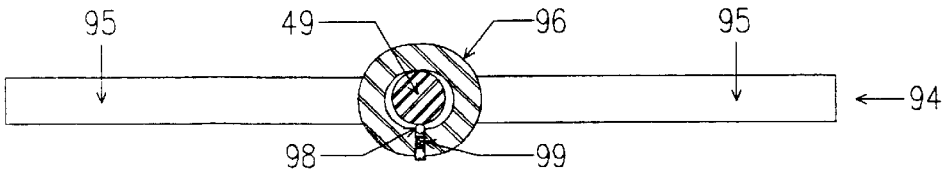
FIG. 18 is a top elevation of an alternate embodiment of the reinforcing rod holder of the present invention.

FIG. 18 depicts yet another embodiment of the present invention. Holder 94 is comprised of a pair of thin flat plate members, severally indicated at 95, for spanning cell 22 of hollow block 20. A thin hollow cylindrical collar 96 is provided between plate members 95. Plate members 95 are attached to the outer diameter of collar 96 in opposed radial fashion. The inner diameter of collar 96 is slightly larger than, and receives, reinforcing rod 49. Collar 96 is provided with a cylindrical lock element 98 disposed in a radial bore contained in collar 96. A spring 99 is also provided within radial bore and is positioned to bias lock element 98 toward the inner circumference of collar 96. Locking element 98 and spring 99 are retained using standard retention means, such as a retaining ring or similar prior art device.

Reinforcing rod 49 is inserted within collar 96 and is suspended by frictional engagement of lock element 98. Spring 99 exerts sufficient force on lock element 98, and hence rod 49, to prevent the rod from dropping down core 51 due to the effects of gravity. However, spring 99 is sized so that rod 49 may be vertically raised upon application of a suitable upward force, hence allowing rod 49 to be raised during the construction of a block wall.

Figure 19:
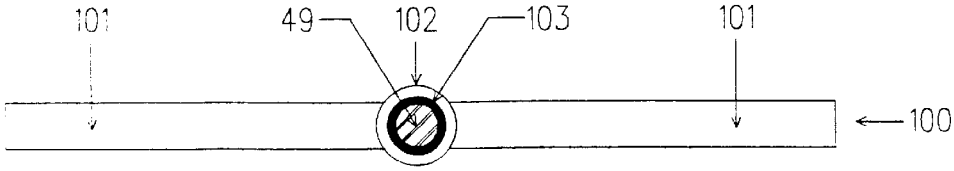
FIG. 19 is a top elevation of an alternate embodiment of the reinforcing rod holder of the present invention.

FIG. 19 depicts yet another embodiment of the present invention, generally similar to the embodiment and operation of that shown in FIG. 18. Here, holder 100 is comprised of a pair of thin flat plate members, severally indicated at 101 for support purposes. A thin, hollow cylindrical collar 102 is provided between plate members 101, and plate members 101 extend radially from the outer diameter of collar 102 in opposed fashion. A hollow cylindrical resilient lock insert 103 is installed within the inner diameter of collar 102 in a concentric fashion. Resilient lock insert 103 may be made of any resilient material, but is preferably comprised of an elastomeric material such as neoprene, ethylene propylene diene monomer (EPDM) or other similar material. The inner diameter of lock insert 103 is slightly less than the outer diameter of reinforcing rod 49. Hence, when reinforcing rod 49 is inserted into the inner diameter of lock insert 103, an interference fit occurs. The friction generated between lock insert 103 and rod 49 is great enough to suspend rod 49 within the core of a hollow block wall. However, upon application of a suitable upward force, rod 49 may be vertically adjusted to overcome the frictional forces caused by the interference fit.

Modifications

The present invention contemplates that many modifications may be made. The particular materials of which the various body parts and components are formed are not deemed critical, and may be readily varied. Further, the various parts and components may take the form shown, or may have some other form, as desired. In addition, while a particular embodiment of holder 32 has been shown and described, numerous variations thereof may be implemented to selectively vertically adjust reinforcing rods in accordance with the principles of the invention. While one particular configuration of a spring and a pair of leg members has been shown, one skilled in the art may modify the configuration to permit vertical adjustment of the reinforcing rods by using any number of configurations.

While holder 32 has been shown to be a continuous wire member having a circular cross section, the cross section might take any geometry. In addition, while the preferred embodiment is a unitary spring wire, it is envisioned that spring and leg members could be separate components. Further, the particular shapes and sizes associated with the holder are not deemed critical. The holder may be modified to retain larger diameter or smaller diameter reinforcing rods. Similarly, while a reinforcing rod having a circular cross section has been shown and described, the present invention is capable of retaining reinforcing rods having various cross sectional geometries. For instance, the reinforcing rod might be square, octagonal, triangular or any other shape.

In the preferred embodiment, reinforcing rods are shown as being retained at both upper and lower ends by the holders of the present invention. In addition, in the preferred embodiment, each holder retains two vertical reinforcing rods. However, the invention may be utilized such that only a single reinforcing rod is retained by each holder. In that regard, two holders could be provided for each individual cell requiring a vertical reinforcing rod. While this would increase the number of holders required to construct a wall, it would also increase the structural strength of the wall by increasing the amount of embedded metal contained within the mortar joints.

The retaining member has been shown to be a singular element meant to retain the vertical reinforcing rod within the gap of the holder. However, the retaining member could take any number of geometries. For instance, the retaining member could be a separate element rather than integral with the leg members. In addition, the retaining member might simply be a clasp or clip placed on one of the leg members following installation of the reinforcing rod. The particular dimensions and geometry of the retaining member are not deemed critical to this invention. Similarly, the orientation of the holder with respect to the hollow blocks is not deemed critical. While the holder has been shown in a nested arrangement in certain embodiments, the holders could easily be provided in other configurations while still serving the purposes of this invention. In addition, the holders may be provided at various positions along a vertical reinforcing rod rather than simply at the upper and lower ends of the rod. This might be useful in situations where very heavy reinforcing rods must be supported against the effects of gravity.

It should be further understood that the force exerted by the leg members on the reinforcing rod may similarly be modified. In some instances, the force must be great enough to suspend the reinforcing rod against the effects of gravity. In other instances, the force must be great enough to suspend the reinforcing rod against the dynamic fluid effects created when pumping grout into the vertical cores of the block wall. The magnitude of the force may be easily adjusted by the design of the spring element incorporated into the holder. The particular lengths of the legs are not deemed critical in that they may be varied to accommodate various block constructions.

Similarly, the specific steps of the method of construction may be varied. While the preferred embodiment shows the installation of six foot rods at everv eighth course, these numbers could easily be varied based on the circumstances. Various length rods could be used, and in constructing the wall, masons may choose to lay several courses of block before reaching in and raising the rod. Similarly, the mason could also prefer to raise the rod above several courses and then install the block. The present invention encompasses all such minor variations.

Therefore, while the presently-preferred form of the holder and method has been shown and described and several modifications thereof discussed, persons skilled in this art will readily appreciate that various additional changes and modifications may be made without departing from the spirit of the invention, as defined and differentiated by the following claims.

What is claimed is:

1. A method of constructing a hollow block wall, comprising the steps of:

providing a plurality of hollow blocks each having a cell extending therethrough;

joining said hollow blocks in end-to-end horizontal relationship with a cementitious binder material to form a first course of blocks;

providing successive courses of blocks atop said first course to form a plurality of stacked courses; said courses joined by a cementitious binder material and arranged such that said cells of said hollow blocks form hollow cores extending vertically through said successive courses;

providing at least one holder for vertically positioning a reinforcing bar within at least one of said cores;

positioning said holder to span said one of said cores;

inserting a vertical reinforcing rod within said one of said cores and engaging said holder such that said rod is vertically suspended within said core;

laying additional successive courses of blocks atop the highest existing course of blocks;

selectively vertically adjusting said reinforcing rod within said holder as said additional courses are laid such that the upper end of said rod is vertically raised to approximately correspond to the height of said additional courses; and filling at least one of said cores with a cementitious binder material.

2. The method as set forth in claim 1 wherein said holder comprises:

a horizontal support structure for spanning one of said cores;

a means for holding said reinforcing rod;

said horizontal support structure arranged in operative relationship with said means for holding to vertically suspend said reinforcing rod within said one of said cores and to selectively permit adjustment of the vertical position of said reinforcing rod.

3. The method as set forth in claim 2 wherein said horizontal support structure is comprised of a first leg member and a second leg member;

said leg members being elongated for spanning one of said cores;

and wherein said means for holding is comprised of a spring having two ends in combination with said first and second members;

said first leg member connected to one of said ends of said spring and said second leg member connected to the other of said ends of said spring;

said first and second leg members so configured and arranged to create a gap therebetween for receiving said reinforcing rod;

said spring adapted to bias said leg members against said reinforcing rod.

4. The method as set forth in claim 3 wherein said step of vertically adjusting is achieved by performing a first rotation of said rod about its axis of elongation within said holder, vertically raising said rod; and performing a second rotation of said rod to substantially lock the vertical position of said rod.

5. The method as set forth in claim 4 wherein said reinforcing rod is provided with a plurality of protrusions spaced regularly on a first portion of the outer surface of said rod to form a plurality of grooves there between, and said rod is provided with a pair of raised planar portions running the length of said rod on a second portion of said outer surface of said rod; and wherein said first rotation causes said leg members to engage said pair of raised planar portions; and said second rotation causes said leg members to engage one of said grooves to lock the vertical position of said rod.

6. The method as set forth in claim 3 further comprising the step of providing an overhead structure such that the distance between said overhead structure and the top of said hollow block wall is insufficient to permit the insertion of said vertical reinforcing rod into said core subsequent to construction.

7. The method as set forth in claim 1 further comprising the step of providing a horizontal reinforcing rod;

raising said vertical reinforcing rod to a position adjacent said horizontal reinforcing rod, and connecting said vertical rod to said horizontal rod.

8. The method as set forth in claim 1 further comprising the step of vibrating said wall to facilitate the flow of said cementitious binder material through at least one of said cores.

* * * * *